US007854336B2

(12) United States Patent
Kerner et al.

(10) Patent No.: US 7,854,336 B2
(45) Date of Patent: Dec. 21, 2010

(54) BEVERAGE DISPENSER HAVING AN AIRTIGHT VALVE AND SEAL

(76) Inventors: Jordan Kerner, 143 North Ave., Westport, CT (US) 06880; Mitchell Hershey, 530 E. 76th St., Apt. 36C, New York, NY (US) 10021

( * ) Notice: Subject to any disclaimer, the term of this patent is extended or adjusted under 35 U.S.C. 154(b) by 1480 days.

(21) Appl. No.: 11/175,065

(22) Filed: Jul. 5, 2005

(65) Prior Publication Data

US 2007/0007226 A1 Jan. 11, 2007

(51) Int. Cl.
*A61J 9/06* (2006.01)
*B65D 51/16* (2006.01)

(52) U.S. Cl. ..... 215/11.4; 215/311; 220/714; 220/717

(58) Field of Classification Search ..... 215/11.4, 215/11.5, 311, 387; 220/714, 717; 229/906.1; 426/117
See application file for complete search history.

(56) References Cited

U.S. PATENT DOCUMENTS

| | | | | |
|---|---|---|---|---|
| 3,117,874 | A * | 1/1964 | Horan | 426/117 |
| 3,779,413 | A * | 12/1973 | Pickerell et al. | 215/11.6 |
| 3,796,337 | A * | 3/1974 | Seunevel | 215/11.6 |
| 3,857,506 | A * | 12/1974 | Hafele | 215/46 |
| 4,333,583 | A * | 6/1982 | Montemarano | 220/712 |
| 4,623,069 | A * | 11/1986 | White | 215/11.1 |
| 5,213,236 | A | 5/1993 | Brown et al. | |
| 5,409,131 | A * | 4/1995 | Phillips et al. | 220/717 |
| 5,553,726 | A * | 9/1996 | Park | 215/11.4 |
| D382,805 | S | 8/1997 | Knickerbocker | |
| 5,664,705 | A * | 9/1997 | Stolper | 222/212 |
| 5,669,530 | A | 9/1997 | Cichon et al. | |
| D385,491 | S | 10/1997 | Mueller et al. | |
| 5,676,270 | A | 10/1997 | Roberts | |
| 5,676,289 | A | 10/1997 | Gross et al. | |
| 5,680,969 | A | 10/1997 | Gross | |
| 5,755,360 | A | 5/1998 | Elliott | |
| 5,769,253 | A | 6/1998 | Gross | |
| 5,769,277 | A | 6/1998 | Elliott | |
| 5,788,108 | A | 8/1998 | Rohr | |
| 5,797,523 | A | 8/1998 | Gross | |
| D398,852 | S | 9/1998 | Gross | |
| D399,744 | S | 10/1998 | Gross | |

(Continued)

FOREIGN PATENT DOCUMENTS

DE 19640187 A1 * 4/1998

(Continued)

*Primary Examiner*—Sue A Weaver
(74) *Attorney, Agent, or Firm*—Sills Cummis & Gross P.C.

(57) ABSTRACT

A beverage dispenser includes a container defining a container volume, and a substantially spill-proof cap, having a suction portion and an aperture on top of the suction portion, coupled to the container. A valve with a slit is inserted between the container and cap so that the slit is placed beneath the aperture of the cap. A pressure sensitive seal is placed on top of the aperture of the cap, so that a vacuum is created between the cap and the beverage inside the container. The slit is formed so that the beverage will flow through the slit of the valve and thus out of the aperture of the cap only if a suction force is applied on the suction portion of the cap 20.

18 Claims, 7 Drawing Sheets

U.S. PATENT DOCUMENTS 5,819,984 A 10/1998 Krueger
5,829,610 A 11/1998 Rohr et al.
5,839,626 A 11/1998 Gross et al.
5,850,953 A 12/1998 Dallas, Jr.
5,853,109 A 12/1998 Elliott
5,875,907 A 3/1999 Lay
5,890,619 A * 4/1999 Belanger ..... 220/713
5,927,549 A 7/1999 Wood
5,927,566 A 7/1999 Mueller
5,934,514 A 8/1999 Lampe et al.
5,938,086 A 8/1999 Gross
5,938,087 A 8/1999 Randall
5,944,234 A 8/1999 Lampe et al.
5,971,232 A 10/1999 Rohr et al.
5,975,368 A 11/1999 Wood
5,992,668 A 11/1999 Elliott
5,873,494 A 12/1999 Dallas, Jr.
6,003,728 A 12/1999 Elliott
6,006,960 A 12/1999 Gross
6,029,866 A 2/2000 Wood et al.
6,045,004 A 4/2000 Elliott
6,050,451 A 4/2000 Hess, III et al.
6,056,142 A 5/2000 Elliott
6,062,435 A 5/2000 Hess, III
6,065,642 A 5/2000 Brown
6,089,419 A 7/2000 Gross
6,095,382 A 8/2000 Gross
6,102,245 A * 8/2000 Haberman ..... 220/714
6,112,951 A 9/2000 Mueller
6,112,952 A 9/2000 Hess, III et al.
6,131,806 A 10/2000 Hess, III et al.
6,143,229 A 11/2000 Socier
6,161,710 A * 12/2000 Dieringer et al. ..... 215/11.4
6,171,623 B1 * 1/2001 Gaylor et al. ..... 426/117
6,176,399 B1 1/2001 Schantz et al.
6,273,307 B1 9/2001 Gross et al.
6,293,437 B1 9/2001 Socier et al.
6,305,563 B1 10/2001 Elliott
6,405,901 B1 6/2002 Schantz et al.
6,439,429 B1 8/2002 Gross
6,793,101 B2 * 9/2004 Shinozaki et al. ..... 222/153.02
7,070,065 B2 * 7/2006 Wong ..... 220/714
7,111,749 B1 * 9/2006 Akers ..... 220/359.2
2002/0063103 A1 * 5/2002 Kiernan ..... 215/11.4
2003/0141302 A1 * 7/2003 Ryan et al. ..... 220/254.1
2004/0166280 A1 8/2004 Mastro
2004/0245203 A1 * 12/2004 Goldman et al. ..... 215/11.4
2005/0269337 A1 * 12/2005 McGrath ..... 220/717

FOREIGN PATENT DOCUMENTS

KR 2003022209 A * 3/2003

* cited by examiner

BEVERAGE DISPENSER HAVING AN AIRTIGHT VALVE AND SEAL

BACKGROUND OF THE INVENTION

1. Field of the Invention

The present invention relates generally to beverage dispensers, and more specifically, to a spill-proof beverage dispenser having an airtight valve and seal.

2. Prior Art

Beverages may be contained by and dispensed from many different types of containers. These include aluminum cans, drink boxes, glass bottles and plastic bottles. Beverage dispensers using the latter two container types may also utilize one or more types of caps, including a screw-on cap, a crimp-on bottle cap, a snap-on cap, and a plunger-based "sport" cap. Moreover, each cap may be constructed from a material that is suitable for its target market and/or expected use.

Some beverage dispensers utilize special caps that are designed to substantially retain beverages inside the dispensers until suction is applied to the cap. These dispensers are often used for sports drinks for adults, as they are less likely to spill their contents if accidentally squeezed, dropped or otherwise tilted. Several patents have been directed to the design of such dispensers. Further, many containers are sold for children that have certain closures to prevent spills.

However, current spill-proof beverage dispensers can be difficult to manufacture, difficult for adults to configure, difficult for children to operate, limited in their uses, or otherwise unsatisfactory. Further, in many of the prior art beverage dispensers, the liquid needs to contain a heat seal over the bottle or be refrigerated, otherwise it would allow bacteria and/or air to get inside the container. Therefore, there is a need for a new spill-proof beverage dispenser that is inexpensive to manufacture, simple and easy for adults and children to use, and that provides an airtight seal between the bottle containing the liquid and the cap of the container holding the liquid so as to keep the beverage free from outside air and therefore bacteria.

SUMMARY OF THE INVENTION

The present invention provides a beverage dispenser that is substantially spill-proof. The present invention also provides a beverage dispenser that provides an airtight seal between the container holding the liquid and the cap of the container, and allows for a simple and easy configuration so that it can be easily used by adults and children.

Accordingly, a beverage dispenser is provided, the beverage dispenser comprising a container for holding a beverage, a cap having an aperture and fixed securely on top of the container, sealing means for covering the aperture, and a valve placed between the container and the cap, wherein the valve in combination with the sealing means forms a vacuum between the cap and a content of the container.

The beverage dispenser further comprises a suction portion on the cap, wherein the aperture is formed on the suction portion. The aperture can have one or more openings. The beverage dispense can further comprise an overcap to cover the cap, aperture and sealing means. The beverage dispense further comprises a coupling for connecting the container and the cap.

The coupling and cap can be formed as one single integrally formed piece. The coupling can have a breakaway area that indicates if the cap has been uncoupled from the container. The sealing means can comprise a pressure sensitive seal, that can be laminated paper. The pressure sensitive seal can be affixed to the cap using an adhesive. The valve can be made of silicone.

The beverage dispense further comprises a circular portion built within the cap to accommodate the valve. The beverage dispense can further comprise an extending portion on the valve that extends into the circular portion of the cap. The valve can have a slit to allow the beverage to flow through the valve. The slit on the valve can be placed beneath the aperture to allow the beverage to flow through the slit on the valve and through the aperture.

Also provided is a cap for a container holding a beverage, the cap comprising an aperture on a top portion of the cap, a sealing means for covering the aperture, and a valve placed underneath the top portion of the cap, wherein the valve in combination with the seal forms a vacuum between the aperture and a content of the container.

Finally, a method is provided of sealing a beverage within a container, the method comprising placing a nozzle underneath a cap of the container so that an outer circumference of the nozzle fits within an inner circumference of the cap, placing a sealing means on an aperture on the cap of the container, and coupling the cap to the container such that the outer circumference of the nozzle fits over the circumference of a top of the container; thereby creating a vacuum within the container.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

These and other features, aspects, and advantages of the apparatus and methods of the present invention will become better understood with regard to the following description, appended claims, and accompanying drawings where:

FIG. 4(*d*) illustrates a cross-sectional side view of the valve of FIG. 4(*a*);

FIG. 4(*e*) illustrates a side view of an upper portion of the valve and suction portion;

DETAILED DESCRIPTION OF THE PREFERRED EMBODIMENT

Although this invention is applicable to numerous and various types of liquid dispensers, it has been found particularly useful in the environment of spill-proof beverage dispensers for children that hold a drinking liquid, such as juice, flavored water, sports drinks and juice/water combinations. Therefore, without limiting the applicability of the invention to the above, the invention will be described in such environment.

Figure 1:
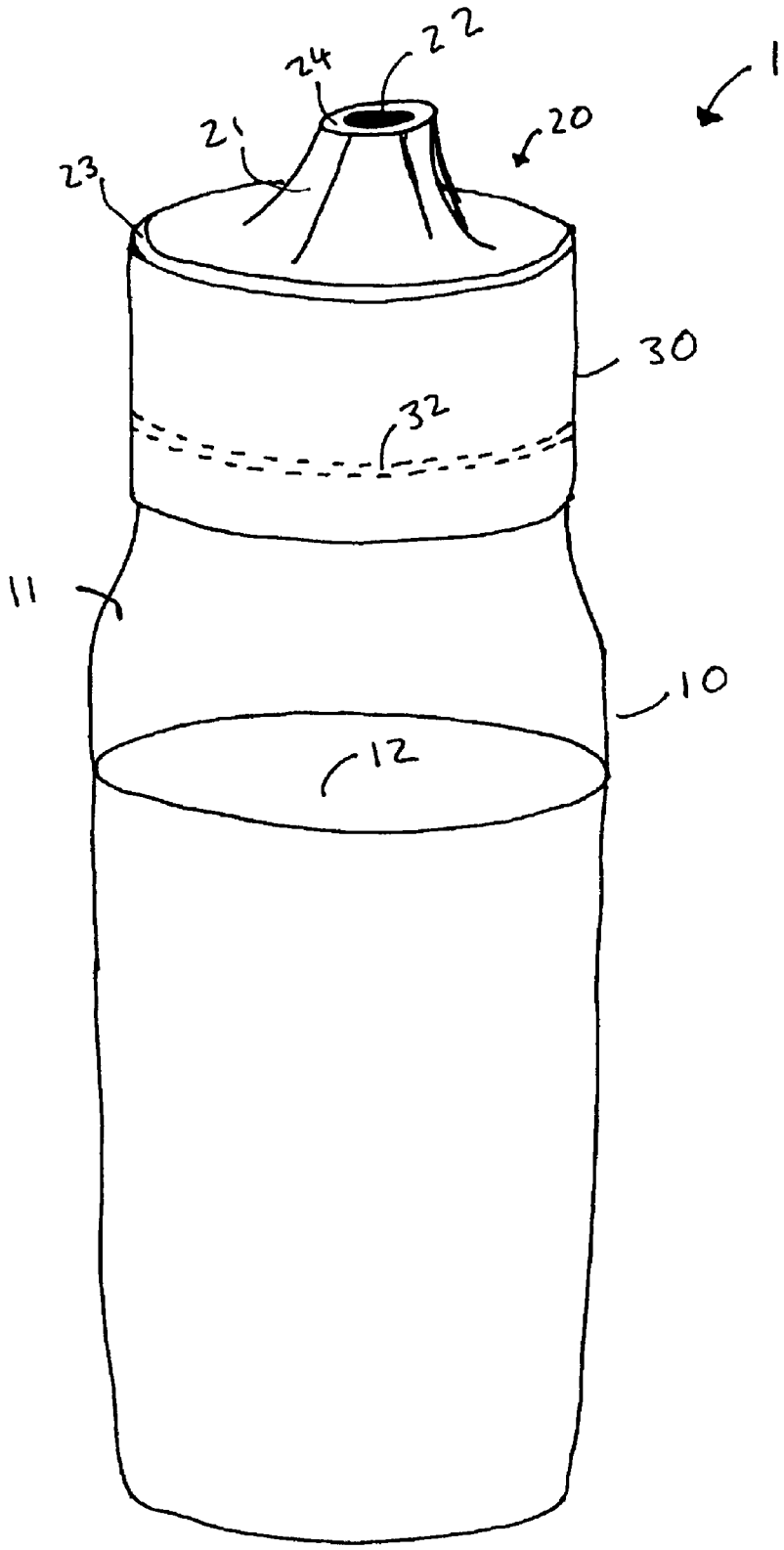
FIG. 1 is a perspective view of a beverage dispenser according to an embodiment of the present invention.

With reference now to the drawings, the components of the present invention will be described. FIG. 1 illustrates a beverage dispenser 1 according to an embodiment of the present invention. Beverage dispenser 1 includes a container 10, which may be comprised of any suitable material, including but not limited to plastic, polyvinyl chloride (PVC), and polyethylene terephthalate (PET). Container 10 may also comprise any shape, size and configuration. Container 10 defines a container volume 11, in which beverage 12 is contained. Beverage 12 may comprise any liquid intended for consumption. According to some embodiments, beverage 12 comprises a liquid intended for consumption by young children, such as water-diluted fruit juice, fruit-flavored water or pure fruit juice. Some embodiments may not include the beverage 12.

Beverage dispenser 1 also includes a cap 20. Cap 20 may comprise a single, integrally-formed piece and/or may also be comprised of one or more suitable materials. In some embodiments, the materials used in beverage dispenser 1 are selected to be easily disposable. Easily disposable materials include materials possessing one or more features such as low cost and recyclability. Accordingly, some embodiments of beverage dispenser 1 are portable, disposable and contain a single serving of juice, diluted juice or flavored water (which may be flavored by juice) intended for children or adults.

Cap 20 includes a suction portion 21 for mating with a mouth during use. A dispensing aperture 22 on an upper surface 24 of suction portion 21 allows the beverage 12 to flow into the mouth during use. The dispensing aperture 22 can comprise one or more openings. The shape of the upper surface 24 can be recessed downward or flat, have a concave shape so that dispensing aperture 22 is formed on a lower surface than upper surface 24, or have a flat shape so that dispensing aperture 22 is formed on a same level as the upper surface 24. Cap 20 can include a lip 23 for holding an overcap 100. An overcap 100 may prevent contaminants such as dust and the like from collecting on suction portion 21 during transport and/or storage of beverage dispenser 1.

Cap 20 may be coupled to the container 10 by any currently or hereafter known coupling system. For example, an interior surface of cap 20 may include a trough into which an upper rim of container 10 may be snapped. Cap 20 may be screwed on to container 10. In FIG. 1, cap 20 is coupled to a coupling 30 having threads on its interior surface, and such threads may interface with threads located on an exterior surface of the neck of container 10. Alternatively, cap 20 and container 10 may consist of a single integrally-formed piece. Also, cap 20 may be formed integrally with coupling 30.

Coupling 30 can be coupled to cap 20 and to container 10. Coupling 30 may serve to fix cap 20 to container 10 and/or may indicate if cap 20 has been uncoupled from container 10. Coupling 30 may also break along breakaway area 32 in a case that cap 20 is uncoupled from container 10. More specifically, coupling 30 may break along breakaway area 32 in a case that cap 20 is turned through a particular arc relative to container 10. The particular arc is based on the design of beverage dispenser 1. Coupling 30 may thereby indicate whether beverage 12 has been tampered with after being sealed in dispenser 1 by a manufacturer. Other couplings having similar functions may also or alternatively be coupled to cap 20 and container 10.

Moreover, container portion 10 may be adapted to substantially maintain its shape in response to inward pressure caused by a child's grip. This feature may prevent beverage 12 from flowing out of the dispensing apertures when pressure is applied to container 10 by a child and suction is not applied to the dispensing apertures. In this regard, a shape of suction portion 20 may conform to a child's mouth.

Figure 2:
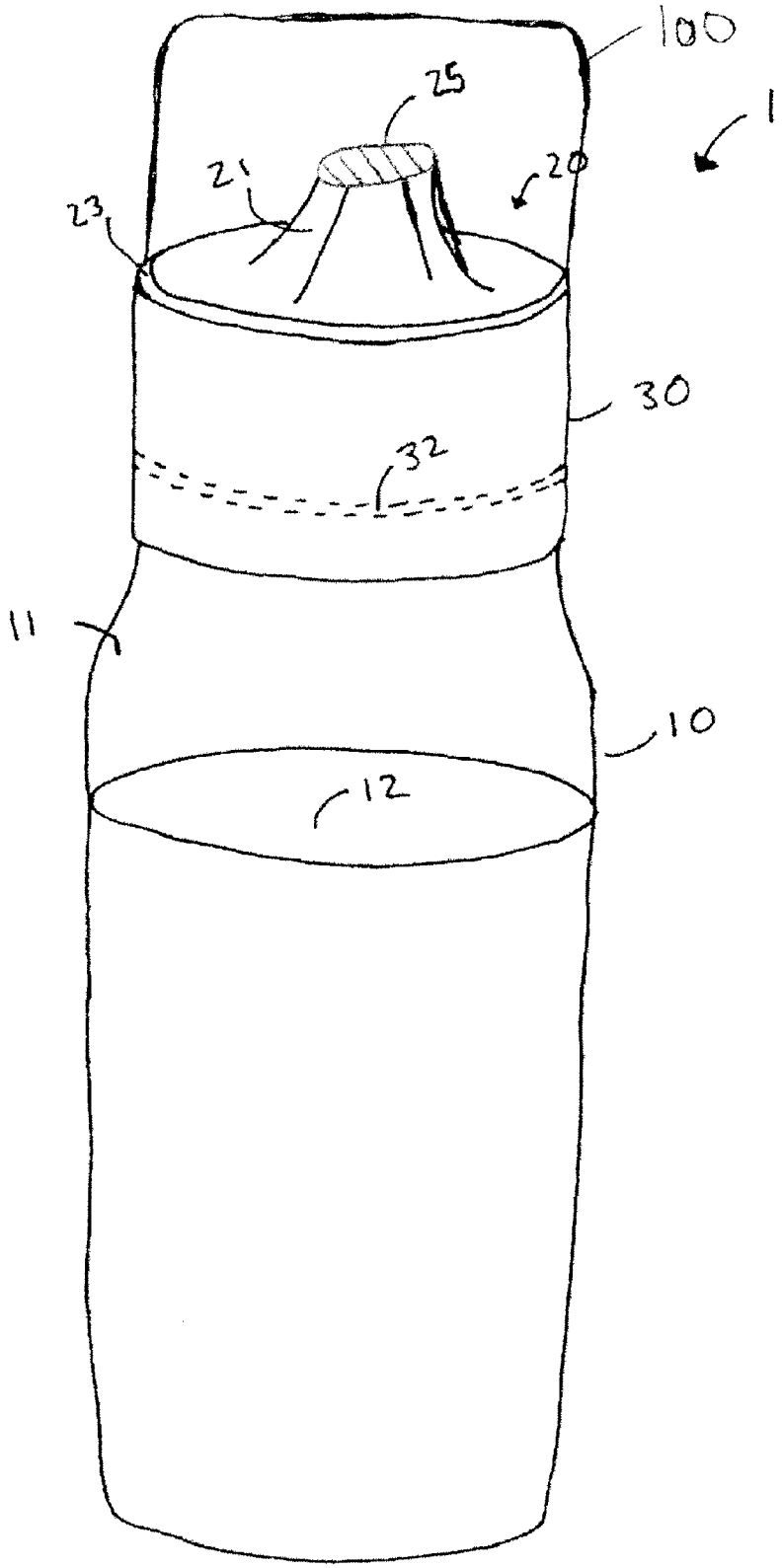
FIG. 2 is the perspective view of the beverage dispenser according to FIG. 1 with a seal on the cap.

FIG. 2 illustrates the beverage dispenser 1 with a seal 25 formed on the top of the suction portion 21, thus covering the upper surface 24 and the aperture 22. The seal 25 is pressure sensitive and is affixed to suction portion 21 to seal the dispensing aperture 22. The seal 25 may comprise a laminated paper, foam, strip of foil that is heat-sealed to cap 20, or may be another material that uses an adhesive to affix the seal 25 to the cap 20. Any sealing means known in the art can be used as seal 25. The seal 25 prevents the flow of contaminants from ambient air to the container volume 11. In this regard, the dispensing aperture 22 is in communication with container volume 11. The seal 25 may also provide an indication of whether seal 25 was previously removed using current or future tamper resistance systems.

Figure 3:
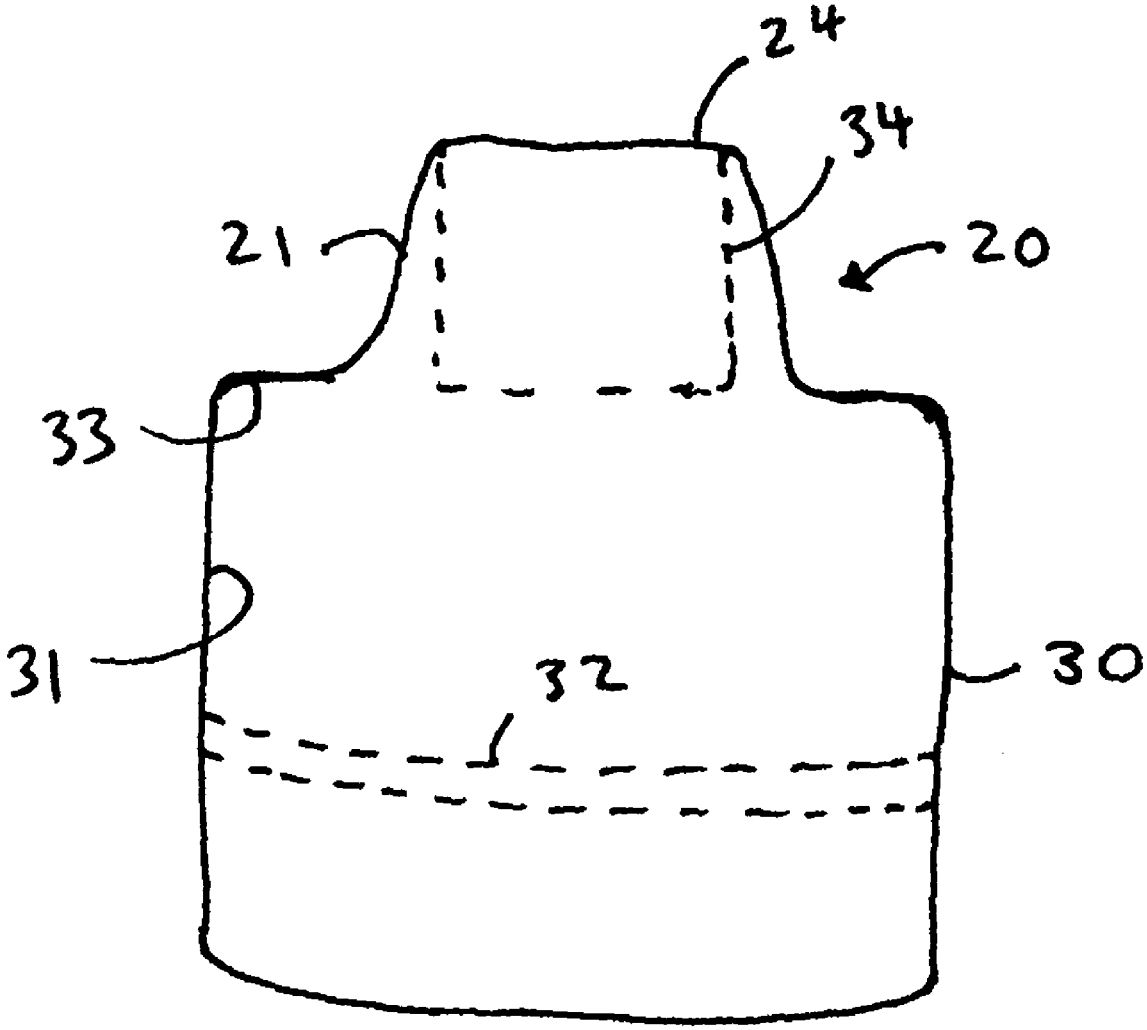
FIG. 3 illustrates a perspective interior view of the cap and coupling of FIG. 1 according to the present invention.

FIG. 3 illustrates an interior view of the cap 20 coupled with the coupling 30 as shown in FIG. 1. The inner wall 31 of the coupling 30 extends vertically along the vertical height of the coupling 30 up to flat portion 33. The flat portion 33 extends from the inner wall 31 to the suction portion 21. A circular portion 34 is built within the suction portion 21, and the circular portion 34 is hollow and extends in a vertical direction until upper surface 24 of the cap 20.

Figure 4:
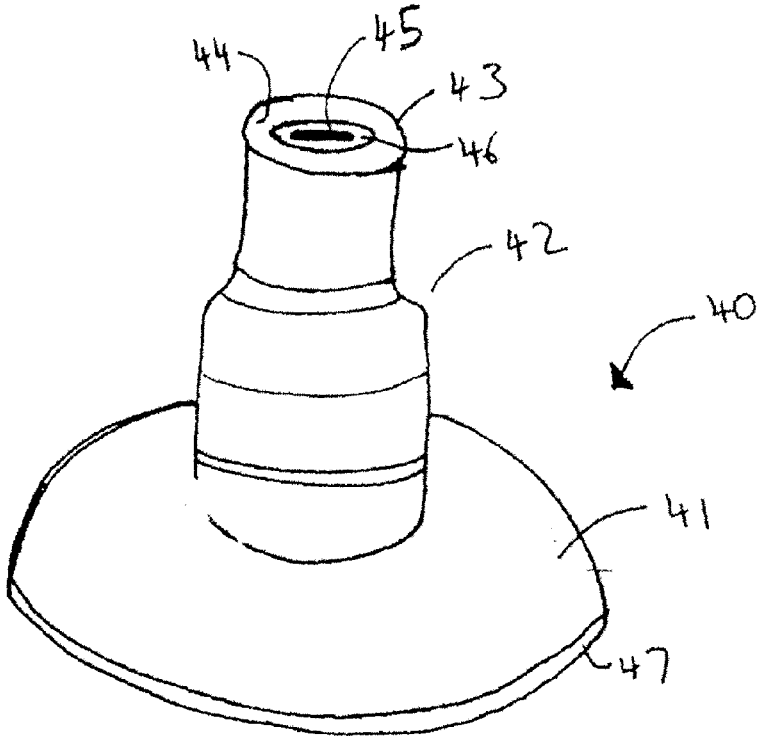
FIG. 4(*c*) illustrates a top view of the valve of FIG. 4(*a*)
Figure 4:
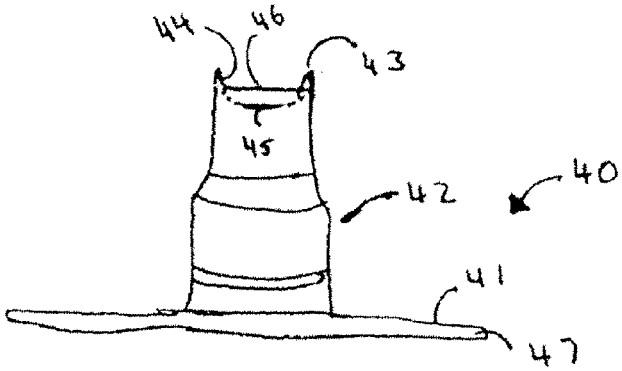
Figure 4C:
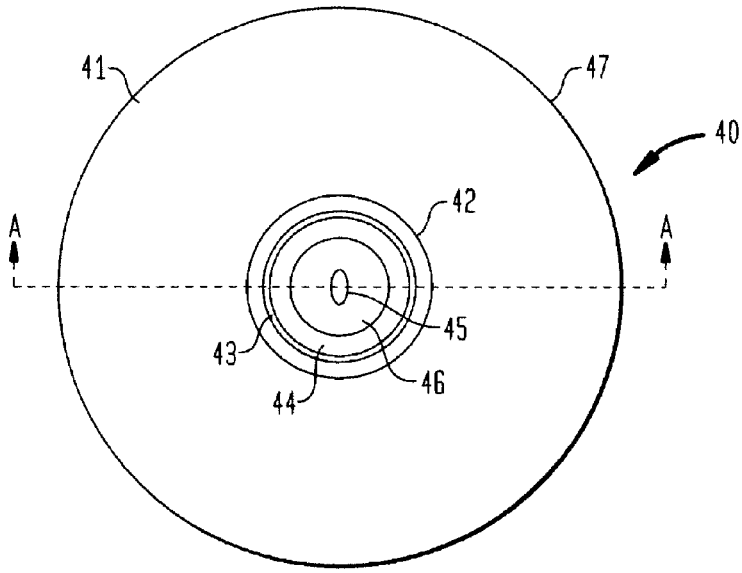
FIG. 4*a* illustrates a perspective view of a valve for use with the beverage dispenser of FIG. 1 according to the present invention.
FIG. 4*b* illustrates a perspective side view of the valve of FIG. 4*a*.
Figure 4D:
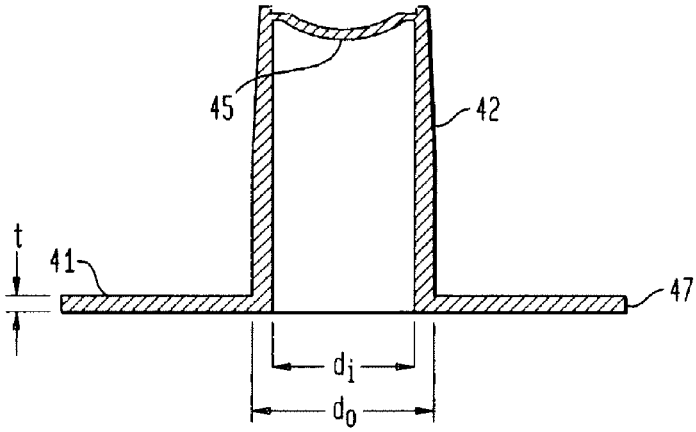
Figure 4E:
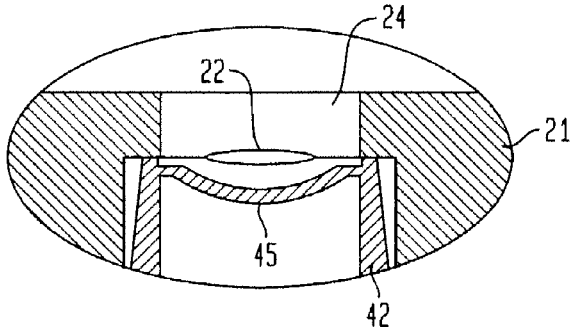

FIG. 4(*a*)-(*e*) illustrates a valve 40 used in connection with the cap 20 to form the spill-proof beverage dispenser 1 according to the present invention. The valve 40 is preferably made of silicone. The valve 40 has a flat portion 41 with an outer circumference 47. The flat portion 41 has an extending portion 42 that extends upward and is located in the middle of the flat portion 41. The top of the extending portion 42 of the valve 40 has an upper rim 43. Upper rim 43 has an inner wall 44, which may be recessed or concave-shaped, as shown in the side view of the valve 40 in FIG. 4(*b*). Middle portion 46 of the upper rim 43 is substantially flat and comprises a slit 45.

Figure 5:
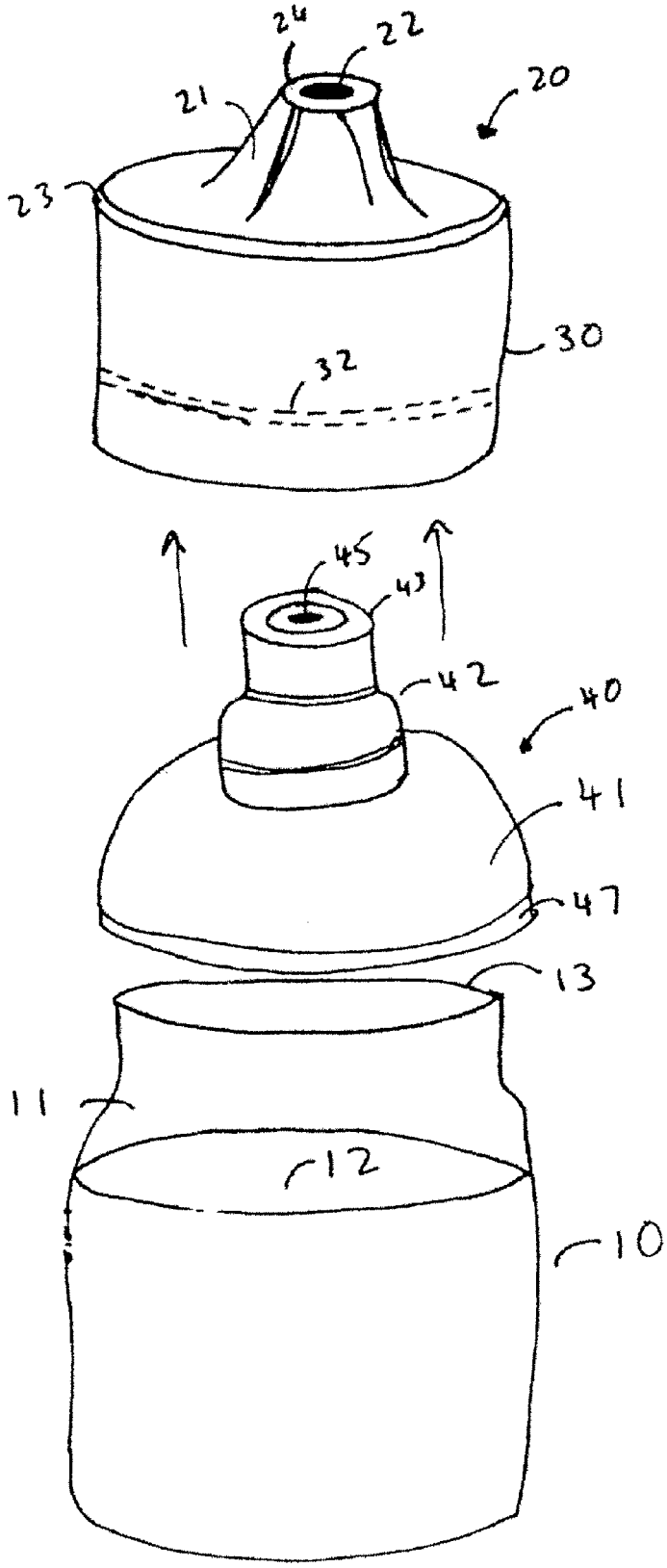
FIG. 5 illustrates the cap, coupling and container of the beverage dispenser of the present invention.

As can be seen in FIG. 5, the valve 40 is inserted through the bottom of the cap 20 and inside the coupling 30. The outer circumference 47 of the flat portion 41 is substantially the same circumference as the inner circumference of the lip 23 so that the valve 40 fits the cap 20. Further, the outer circumference 47 extends out and covers the circumference 13 of the top of the container 10, providing an airtight seal between the cap 20 and the container 10 that can withstand the process of heating and cooling, and inherent expansion and contraction, during pasteurization of some beverages, thus creating a vacuum.

The extending portion 42 of the valve 40 has substantially the same height as the sucking portion 21. The extending portion 42 fits directly inside the circular portion 34 within the suction portion 21. The upper rim 43 of the valve 40 has substantially the same circumference as the upper surface 24 of the cap 20. The slit 45 of the valve 40 can be placed beneath the aperture 24, to allow the liquid to flow through the slit 45 and through the aperture 22.

Operation of the present invention will now be described with references to the figures and components described above, and as shown in FIG. 6.

Figure 6:
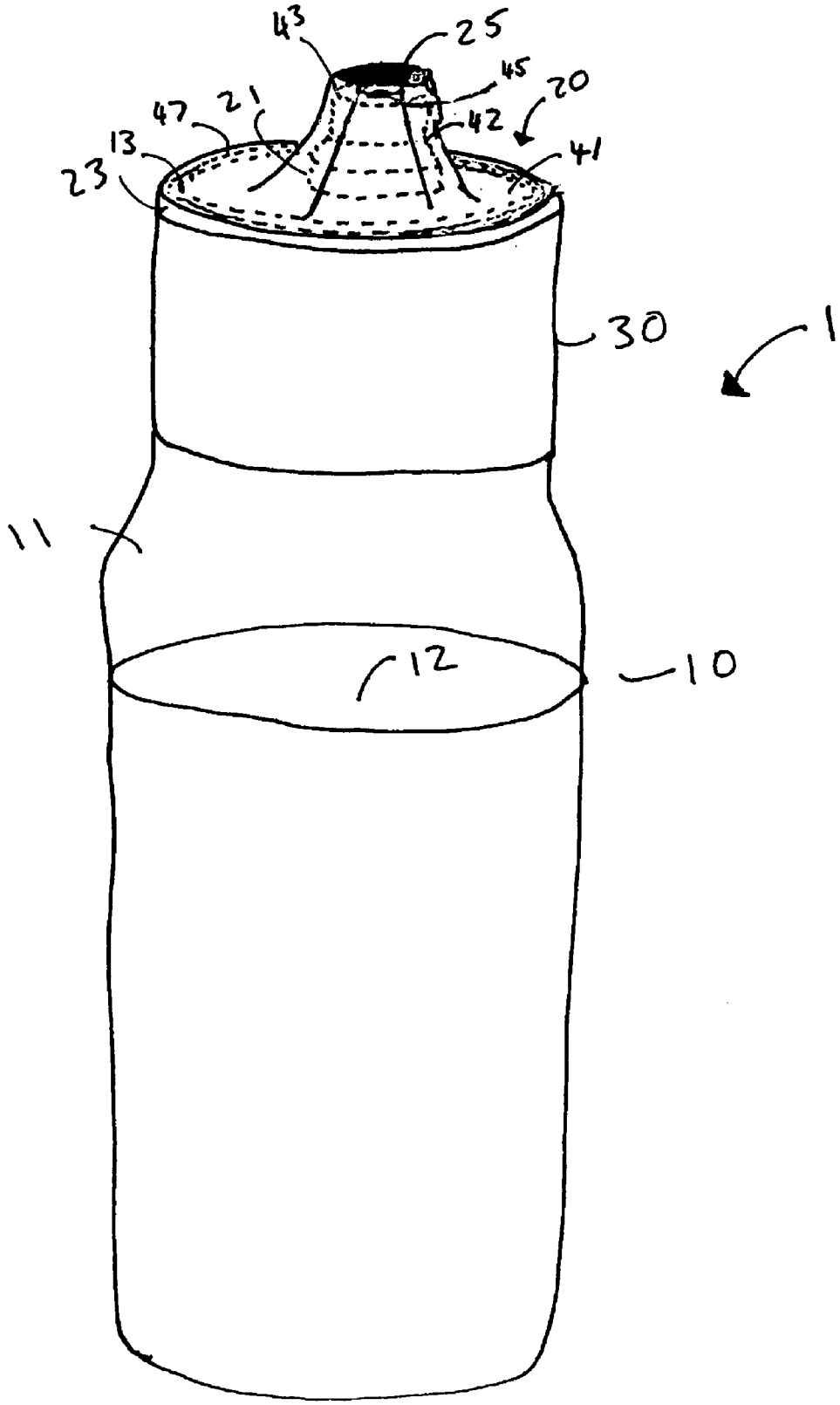
FIG. 6 illustrates a perspective view of the valve, cap, coupling and container of the beverage dispenser of the present invention.

As seen in FIG. 6, the valve 40 is fitted within the cap 20. The outer circumference 47 of the valve 40 fits within the inner circumference of the lip 23. Further, the outer circumference 47 of the valve 40 fits over the circumference 13 of the top of the container 10. Combined with the pressure sensitive seal 25, this configuration provides for an airtight seal (vacuum) between the beverage 12 inside the container 10 and the cap 20, thus protecting the beverage 12 from ambient air.

During pasteurization (partial sterilization of the beverage at a certain temperature and for a period of exposure that destroys objectionable organisms without major chemical alteration of the beverage), the juice or juice/water combination is heated to approximately 183 degrees Fahrenheit in order to make sure that no harmful bacteria remains in the bottled juice. The product is then cooled in a "cooling tunnel" at a scientifically determined rate in order to create a vacuum inside the bottle sealing the beverage off from air so that no bacteria is permitted inside to grow in the beverage.

This air tight environment ensures that no harmful bacteria is introduced and allows for the product to be "shelf stable", or have a long shelf life without refrigeration. The valve 40 acts like a liner to create a seal or bond between the container 10 and cap 20. Therefore, the content of the container 10, or beverage 12, is not exposed to any bacteria or air, and therefore the beverage dispenser 1 does not require refrigeration. This significantly improves the length of time the beverage dispenser can sit on a shelf, without a need to be refrigerated.

In use, an adult or child will only have to remove the overcap, if provided, and peel the seal 25 off and drink it. When an adult or child grasps the container 10, and shakes or turns the container 10 upside-down, the beverage 12 will push against the valve 40. Such a situation may also occur if the beverage dispenser 1 is knocked over from an upright position. However, the slit 45 is small, and such that it will not allow the beverage 12 to seep through the slit 45 and thus out of the aperture 22 of the cap 20. The adult or child will have to apply suction on the suction portion 21 to cause the beverage 12 to flow out of the slit 45, and thus, out of the aperture 22 and into the person's mouth. Thus, the combination of the valve 20 and the cap 20 also makes the beverage dispenser substantially spill-proof.

The present invention provides several advantages that solve the problems with prior art methods. It provides a beverage dispenser that is substantially spill proof based on the combination of the valve and the cap. The slit 45 of the valve is formed so that the beverage 12 can only flow through the slit 45 and thus through the aperture 22 of the cap 20 if a suction force is applied to the suction portion 21 of the cap 20. Further, the combination of the silicone valve and the pressure sensitive seal 25 on the cap 20 provides an airtight seal and vacuum to prolong the shelf life of the beverage dispenser 12, by preventing air and bacteria to enter the container 10. Further, the valve 40 is simple in design and manufacture.

The above description of the present invention is only the preferred embodiment of the invention. Embodiments may include any currently or hereafter-known versions of the elements described herein. Any means can be used to seal the aperture on the cap, other than foil or laminated paper. Different types of containers may be used, and of various shapes. Various shapes may be used for the cap, including the shape of the suction portion. Different couplings for coupling the container with the cap may be used. The coupling may be part of or separate from the container and/or the cap. The valve, container and cap are not limited to circular embodiments as shown in the figures, but can easily be shaped to accommodate other sizes while preserving the principles of the present invention, as would be obvious to one or ordinary skill in the art.

Various other combinations of any type of seal, coupling, container, lips, rims and caps may be used in conjunction with the embodiment described above. Dispensing apertures according to some embodiments may differ from those described herein, and some embodiments may include only one dispensing aperture. The materials selected for each part may differ, depending on several factors such as ease of manufacture, price, safety, etc. Therefore, persons skilled in the art will recognize from this description that other embodiments may be practiced with various modifications and alterations.

There are several other uses of the invention not limited by the preferred description and embodiment as described above. The invention may also have other uses in other fields in other similar applications.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A beverage dispenser comprising:

a container for holding a beverage, the container having a top circumference;

a cap having an aperture and fixed securely on top of the container, the cap having an inner circumference;

sealing means for covering the aperture; and a valve, the valve having a flat portion with an outer circumference and an extending portion, the extending portion having an upper rim, the upper rim having a recessed inner wall with a slit, the outer circumference of the valve being placed between the top circumference of the container and the inner circumference of the cap;

wherein the placement of the outer circumference of the valve in combination with the sealing means forms an airtight seal between the cap and a content of the container.

2. The beverage dispenser of claim 1, further comprising:

a suction portion on the cap, wherein the aperture is formed on the suction portion.

3. The beverage dispenser of claim 1, further comprising:

one or more openings on the aperture.

4. The beverage dispenser of claim 1, further comprising:

an overcap to cover the cap, aperture and sealing means.

5. The beverage dispenser of claim 1, further comprising:

a coupling for connecting the container and the cap.

6. The beverage dispenser of claim 5, wherein the coupling and cap are formed as one single integrally formed piece.

7. The beverage dispenser of claim 5, further comprising:

a breakaway area on the coupling that indicates if the cap has been uncoupled from the container.

8. The beverage dispenser of claim 1, wherein the sealing means comprises a pressure sensitive seal.

9. The beverage dispenser of claim 8, wherein the pressure sensitive seal comprises laminated paper.

10. The beverage dispenser of claim 8, wherein the pressure sensitive seal is affixed to the cap using an adhesive.

11. The beverage dispenser of claim 1, wherein the valve comprises a material made of silicone rubber.

12. The beverage dispenser of claim 1, further comprising:

a circular portion built within the cap to accommodate the valve.

13. The beverage dispenser of claim 12 wherein the extending portion on the valve extends into the circular portion of the cap.

14. The beverage dispenser of claim 1 wherein the slit on the valve allows the beverage to flow through the valve.

15. The beverage dispenser of claim 14, wherein the slit on the valve is placed beneath the aperture to allow the beverage to flow through the slit on the valve and through the aperture.

16. A beverage dispenser having an airtight seal comprising:

a container, the container holding a beverage within a container volume, the container having a top circumference;

a cap, the cap including an inner circumference, a first flat portion, a suction portion and a dispensing aperture, the first flat portion extending from the inner circumference to the suction portion, the suction portion being located in the middle of the first flat portion and extending in a vertical direction from the first flat portion to the dispensing aperture, the suction portion including a hollow portion;

a seal for covering the dispensing aperture; and a valve, the valve including an outer circumference, a second flat portion, an extending portion and an upper rim, the second flat portion extending from the outer circumference to the extending portion, the extending portion being located in the middle of the second flat portion and extending upwards to the upper rim, the upper rim having a recessed inner wall with a slit, wherein the valve is fitted within the cap in such a way that the outer circumference of the valve is fitted between the inner circumference of the cap and the top circumference of the container, and the extending portion is fitted directly inside the hollow portion of the suction portion.

17. The beverage dispenser of claim 16 further comprising:

a lip on the cap; and an overcap, the overcap being held to the cap via the lip, the overcap preventing contaminants from collecting on the suction portion.

18. The beverage dispenser of claim 16 wherein the seal prevents a flow of contaminants from the ambient air to the container volume.

* * * * *